US008443998B2

(12) United States Patent
Domoy

(10) Patent No.: US 8,443,998 B2
(45) Date of Patent: May 21, 2013

(54) CONTAINER WITH INTEGRATED PLASTIC TEAR AWAY MEMBRANE

(75) Inventor: Brett Christopher Domoy, Medina, NY (US)

(73) Assignee: Conopco, Inc., Englewood Cliffs, NJ (US)

( * ) Notice: Subject to any disclaimer, the term of this patent is extended or adjusted under 35 U.S.C. 154(b) by 11 days.

(21) Appl. No.: 13/163,887

(22) Filed: Jun. 20, 2011

(65) Prior Publication Data

US 2012/0318798 A1 Dec. 20, 2012

(51) Int. Cl.
*B65D 51/20* (2006.01)
*B65D 17/34* (2006.01)

(52) U.S. Cl.
USPC ..... 220/258.2; 220/257.2; 220/359.2

(58) Field of Classification Search
USPC ..... 53/42; 206/530; 220/258.1–258.4, 220/257.2, 254.1, 359.1, 359.2, 359.4, 695, 220/265, 266, 350, 351, 702, 735, 276, 277, 220/799, 255.1, 256.1, 528, 570
See application file for complete search history.

(56) References Cited

U.S. PATENT DOCUMENTS

| | | | | |
|---|---|---|---|---|
| 3,472,415 | A * | 10/1969 | Woodruff | 220/277 |
| 4,018,357 | A * | 4/1977 | Ostrem | 220/268 |
| 4,702,387 | A * | 10/1987 | Wombold | 220/270 |
| 4,724,977 | A | 2/1988 | Cleevely | |
| 5,667,092 | A * | 9/1997 | Julius et al. | 220/259.1 |
| 6,761,279 | B1 * | 7/2004 | Martin et al. | 220/258.2 |
| 8,113,374 | B2 * | 2/2012 | Steiger et al. | 220/258.4 |
| 2010/0308065 | A1 * | 12/2010 | Vandamme et al. | 220/697 |

FOREIGN PATENT DOCUMENTS

| | | | |
|---|---|---|---|
| EP | 1157936 | A2 | 11/2001 |
| EP | 1462379 | A2 | 9/2004 |
| FR | 2824813 | A | 11/2002 |
| FR | 2824813 | A1 | 11/2002 |
| WO | W02009109480 | A2 | 9/2009 |

OTHER PUBLICATIONS

PCT International Search Report in a PCT application PCT/EP2012/057958 dated Jul. 4, 2012 with Written Opinion.

* cited by examiner

*Primary Examiner* — Bryon Gehman
*Assistant Examiner* — Shawn Braden
(74) *Attorney, Agent, or Firm* — Michael P. Aronson

(57) ABSTRACT

A container is provided which includes a container body, a cap closure and a plastic membrane. The container body has a receiving area capable of holding a product. An open mouth surrounds the receiving area. A cap closure is arranged over the open mouth. The cap closure includes a fitment engageable around the mouth and a lid hingedly connected to the fitment. The plastic membrane is integrally molded with the cap closure and sealingly prevents leakage from the receiving area. The membrane includes a minor area non-frangibly attached to the fitment having a V-shaped outer border with sections of the border converging to a pivot point, and a major area tangibly attached along its perimeter to the fitment and to the V-shaped outer border. A pull tab is formed on a surface of the membrane at the pivot point.

6 Claims, 5 Drawing Sheets

CONTAINER WITH INTEGRATED PLASTIC TEAR AWAY MEMBRANE

BACKGROUND OF THE INVENTION

1. Field of the Invention

The invention concerns a frangible membrane for sealing containers, particularly for sealing jars having a flip-top cap closure.

2. The Related Art

WO 2009/109480 (Domoy et al.) discloses a jar for a cosmetic product, advantageously for cold cream or petrolatum. The jar has a non-circular container body and a cap closure. The cap closure includes a fitment engagable around the mouth of the jar. A lid is hingedly connected to the fitment.

Jars of the aforementioned description have experienced a number of problems. Under extremely hot climate conditions, mobility of product contained within the jar increases to the level of leakage. Also there is the issue of potential tampering.

Accordingly, there is a need to develop a seal system that provides a potential purchaser evidence of non-tamper on a retail shelf. Also there is a need for a seal that prevents any product leakage, especially for those products distributed in hot climates.

SUMMARY OF THE INVENTION

A container is provided which includes:

(i) a container body with a receiving area capable of holding a product, the container having an open mouth surrounding the receiving area;

(ii) a cap closure arranged over the open mouth, the closure including a fitment engagable around the mouth and a lid hingedly connected to the fitment; and (iii) a plastic membrane integrally molded with the cap closure and surrounded by a supporting wall projecting upwards from the fitment, the membrane sealingly closing off the mouth, the membrane including:

(a) at one end a minor area non-frangibly attached to the supporting wall which is a shelf having a V-shaped outer border with sections of the border angularly converging to a pivot point;

(b) a major area at a second end of the membrane in part being frangibly attached along a perimeter thereof to the supporting wall and in another part of the perimeter to the V-shaped outer border; and (c) a pull tab projecting outwardly from a surface of the membrane and attached adjacent to the pivot point of the V-shaped outer border.

BRIEF DESCRIPTION OF THE DRAWING

Further features and advantages of the present invention will become more evident upon consideration of the drawing in which.

DETAILED DESCRIPTION OF THE INVENTION

Previous problems of leakage and absence of a non-tamper proof seal have been resolved by use of a fracturable membrane co-injection molded with the cap closure.

Figure 1:
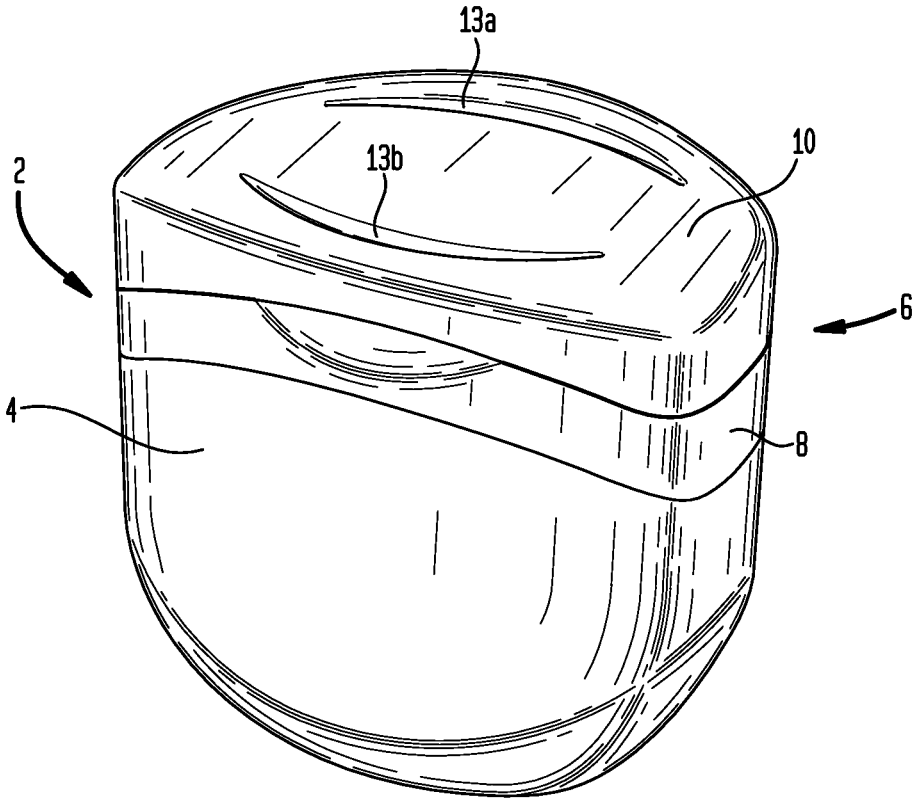
FIG. 1 is a perspective view of a container according to the present invention.

FIG. 1 illustrates a preferred embodiment. Therein is shown a container 2 featuring a container body 4 with an open mouth secured by a cap closure 6. The closure includes a fitment 8 and a hingedly connected lid 10.

Lid 10 is attached to the fitment via a hinge 11. Crescent shaped indentations 13*a*, 13*b* face one another and are fashioned into a roof of the lid.

Figure 2:
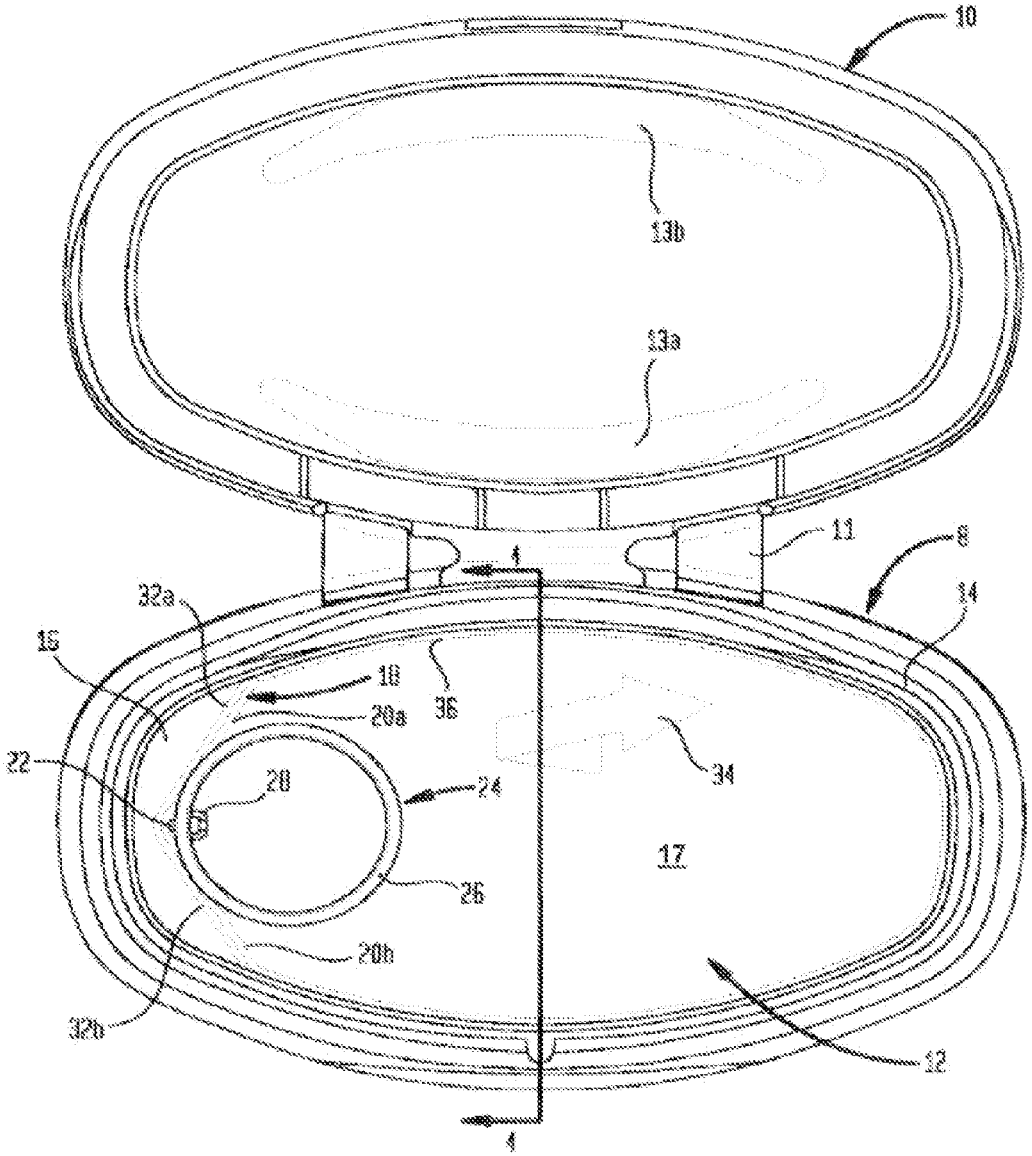
FIG. 2 is a top view of a cap closure in an open position.
Figure 3:
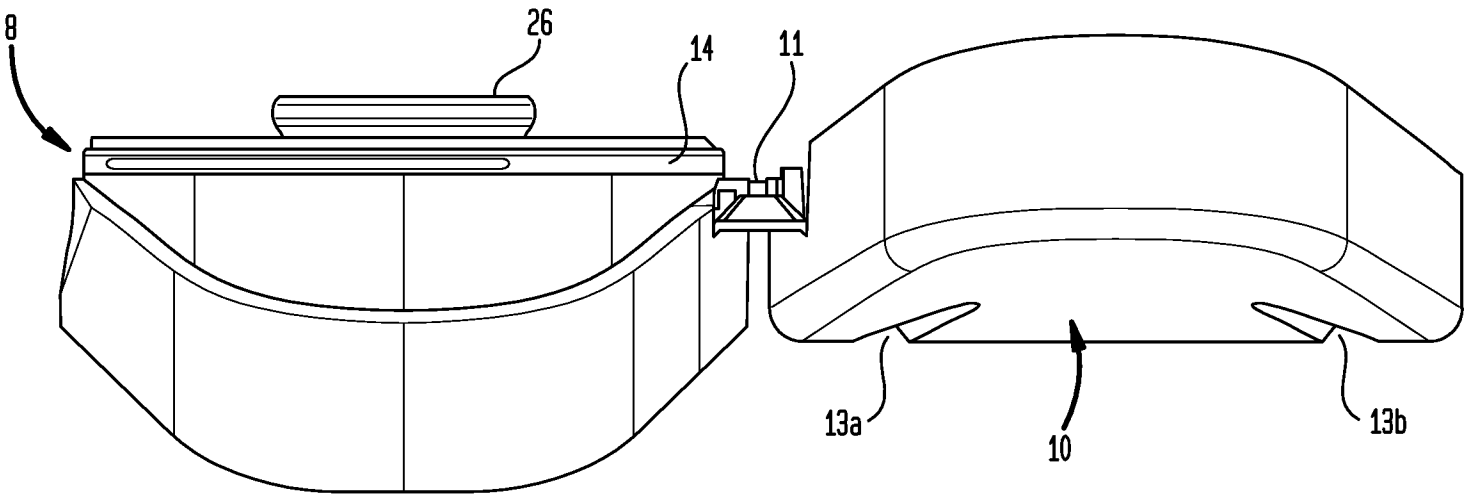
FIG. 3 is a right side plan view of he open cap closure shown in FIG. 2.

FIGS. 2 and 3 illustrate a plastic membrane 12 integrally molded with the cap closure and serving to sealingly dose off the mouth of the container body. A supporting wall 14 projects upward from the fitment and surrounds the membrane.

The membrane at one end has a minor area non-frangibly attached to the supporting wall which is a shelf 16. The shelf has a V-shaped outer border 18 with sections of the border 20*a*, 20*b* angularly converging to a pivot point 22. A major area of the membrane is a removable section 17, frangibly attached to the supporting wall and shelf.

Figure 4:
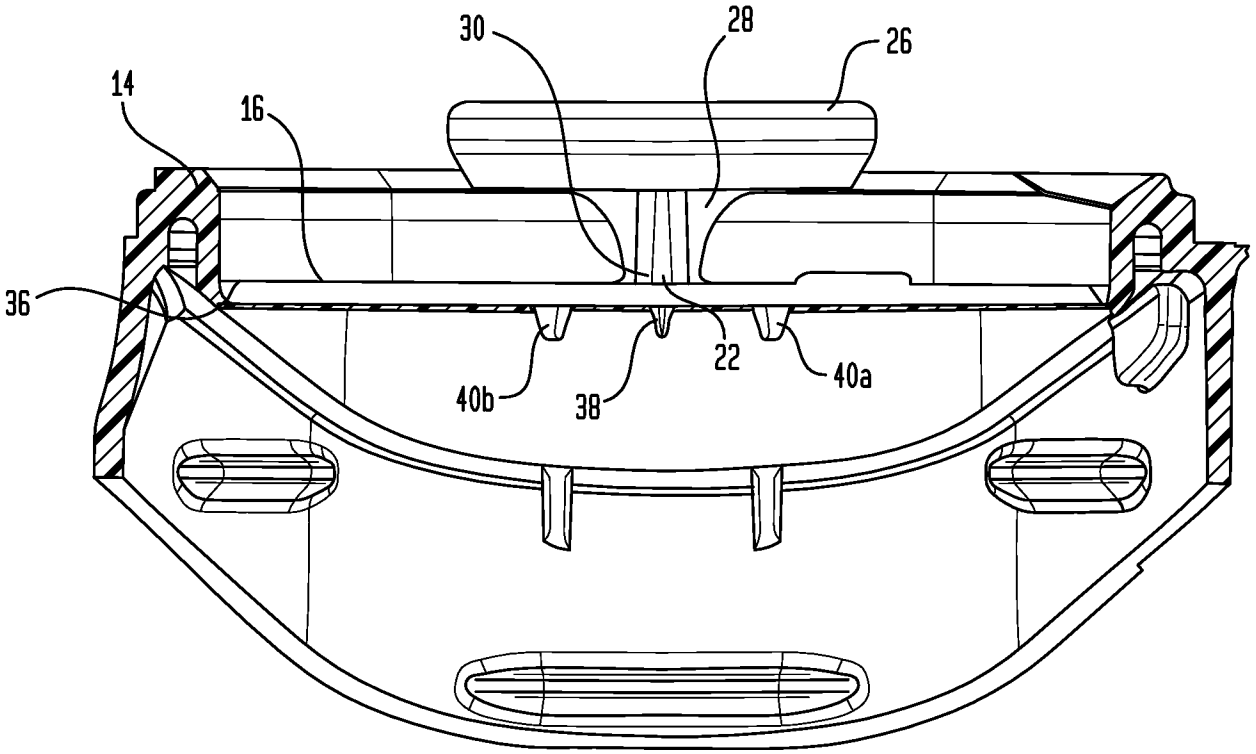
FIG. 4 is a cross-sectional view along line 4-4 shown in FIG. 2.

A pull tab 24 may in a preferred embodiment be a ring 26. Support to the ring is provided by an attached post 28 projecting outwardly from a surface of the membrane adjacent the pivot point 22. The post at point of attachment to the membrane as shown in FIG. 4 features at least two feet 30 giving the post a broader connection than a diameter of the post at the ring attachment end.

A pair of intersecting bars 32*a*, 32*b* are formed on the minor area (i.e. the shelf) of the membrane. Together these bars trace the V-shaped outer border along at least 80% of a length thereof. The bars form an angle at the point of intersection ranging from 90 to 170°, preferably from 110 to 150° C.

Indicia including a directional arrow 34 can be molded into the membrane as instructional for consumers on how to remove the seal. Along a border of the removable section 17 of the membrane and tracing along the V-shaped outer border of the shelf is a narrow web 36 easily torn by a consumers upwardly pulling motion on the ring 26. Thickness of the membrane relative to the web may range from about 20:1 to about 5:1 preferably from about 15:1 to about 8:1, and optimally about 10:1. In a preferred embodiment, the web is $^{30}/_{1,000}$ of an inch thick and the web is $^{3}/_{1,000}$ of an inch thick (2.54 cm to the inch). Improvement in the ease of fracturing the web require the post to be attached to the membrane as close as possible to the pivot point 22.

Additionally, it is desirable to have the V-shaped outer border 18 be at the smallest angle possible. A counter factor to a smaller angle is the practical requirement that shelf 16 not substantially obstruct access to the product in the container body. When the product is petrolatum, the shelf serves the further purpose of allowing a consumer to wipe off excess petrolatum from their finger against borders of the shelf.

Figure 5:
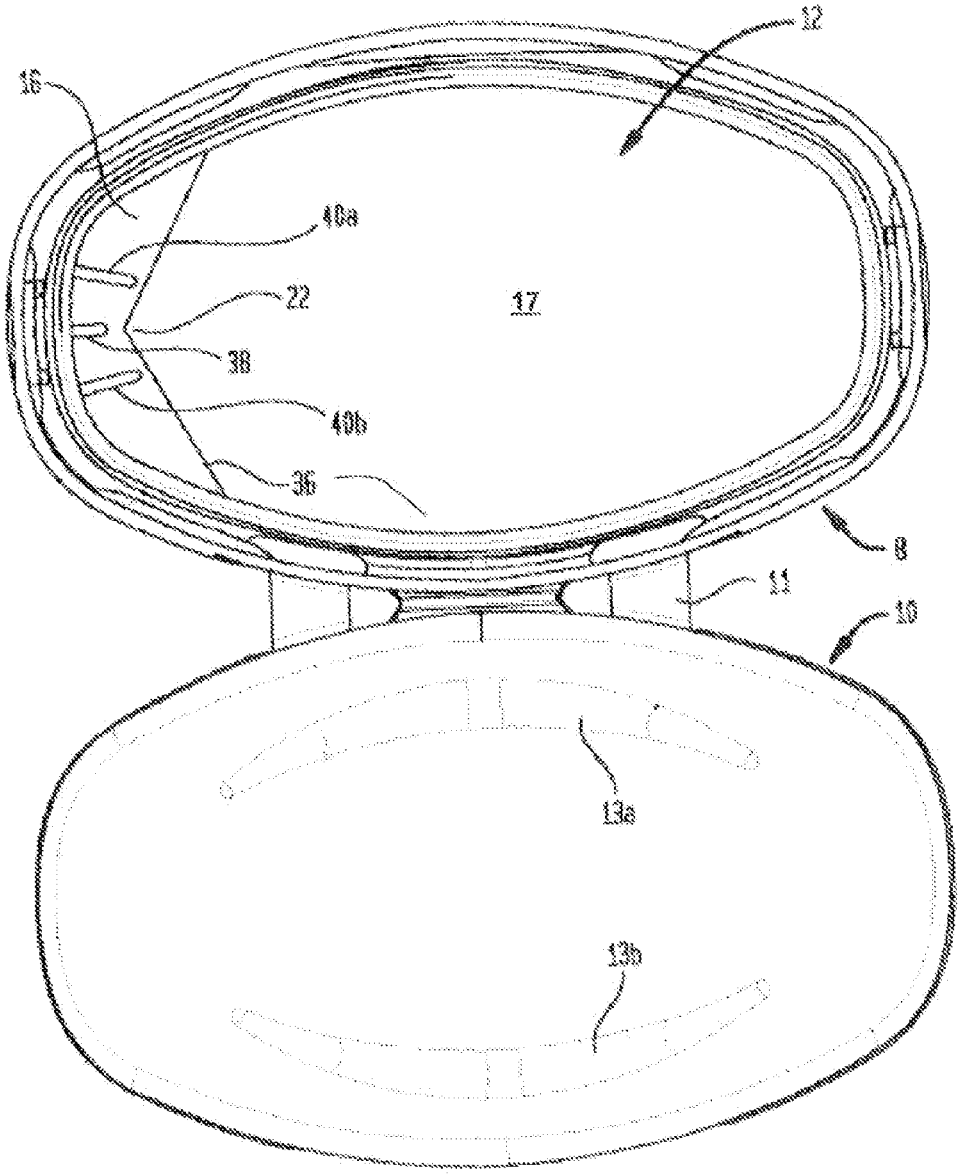
FIG. 5 is an underside view of the open cap closure shown in FIG. 2.

FIG. 5 is an opposite face (undersurface) view of the plastic membrane 12. It reveals the trace of the frangible web 36 and, with special clarity, the V-shaped outer border 18 of shelf 16. Best seen in this illustration is a central rib 38 projecting downwardly into the container body and having a length oriented toward the pivot point 22. In the preferred embodiment, a lateral rib 40*a*, 40*b* flanks each side of the central rib and are similarly arranged on the shelf projecting downward into the container body. Both of the lateral ribs are longer than the central rib and taper toward one another.

While the invention has been described in detail with reference to specific embodiments thereof, it will be apparent to one skilled in the art that various changes and modifications can be made therein without departing from the spirit and scope thereof.

What is claimed is:

1. A container comprising:

(i) a container body with a receiving area capable of holding a product, the container having an open mouth surrounding the receiving area;

(ii) a cap closure arranged over the open mouth, the closure comprising a fitment engagable around the mouth and a lid hingedly connected to the fitment: and (iii) a plastic membrane integrally molded with the cap closure and surrounded by a supporting wall protecting upwards from the fitment, the membrane sealingly closing off the mouth, the membrane comprising:

(a) at one end a minor area non-frangibly attached to the supporting wall which is a shelf having a V-shaped outer border with sections of the border angularly converging to a pivot point and further comprising a pair of intersecting bars formed on the minor area and tracing the V-shaped outer border along at least 80% of a length thereof wherein the bars form an angle at a point of intersection ranging from 90 to 170°;

(b) a major area at a second end of the membrane in part being frangibly attached along a perimeter of said major area to the supporting wall and in another part of the perimeter to the V-shaped outer border; and (c) a pull tab projecting outwardly from a surface of the membrane comprising a ring and a post, the ring being supported by the post and attached adjacent to the pivot point of the V-shaped outer border.

2. The container according to claim 1 wherein the bars form an angle at a point of intersection ranging from 110 to 150°.

3. The container according to claim 1 wherein the post at an end attached to the membrane features at least two feet broadening the end.

4. The container according to claim 1 further comprising on an undersurface of the shelf a central rib projecting downwardly into the container with a length oriented toward the pivot point.

5. The container according to claim 4 further comprising on the undersurface of the shelf a lateral rib flanking each side of the central rib, the flanking ribs having a longer dimension than that of the central rib.

6. The container according to claim 4 wherein the flanking ribs taper inward toward one another.

* * * * *